United States Patent [19]

Zimmer

[11] Patent Number: 4,943,451

[45] Date of Patent: Jul. 24, 1990

[54] PROCESS AND DEVICE FOR APPLYING A FLOWABLE SUBSTANCE TO A SURFACE

[76] Inventor: Johannes Zimmer, Ebentaler Strasse 133, A-9020 Klagenfurt, Austria

[21] Appl. No.: 10,084

[22] PCT Filed: May 6, 1986

[86] PCT No.: PCT/AT86/00040

§ 371 Date: Feb. 26, 1987

§ 102(e) Date: Feb. 26, 1987

[87] PCT Pub. No.: WO86/06656

PCT Pub. Date: Nov. 20, 1986

[30] Foreign Application Priority Data

May 8, 1985 [AT] Austria ..... 1390/85

[51] Int. Cl.[5] ..... B05D 3/12; B05D 3/00; B05C 3/18

[52] U.S. Cl. ..... 427/294; 118/410; 118/411; 118/413; 118/415; 427/209; 427/244; 427/355; 427/369

[58] Field of Search ..... 118/410, 411, 415, 413; 427/244, 369, 355, 356, 358, 294, 209

[56] References Cited

U.S. PATENT DOCUMENTS

| | | | |
|---|---|---|---|
| 3,418,970 | 12/1968 | Phelps et al. | 118/413 X |
| 3,899,999 | 8/1975 | Christ et al. | 118/411 X |
| 3,919,974 | 11/1975 | Herzog | 118/410 |
| 4,094,241 | 6/1978 | Kössler | 118/406 X |

*Primary Examiner*—Evan Lawrence
*Attorney, Agent, or Firm*—Herbert Dubno

[57] ABSTRACT

In a process and a device for the impregnating and/or coating application of liquid, optionally foamed substances, through a slot the parts of the device performing the application are arranged to form a surface almost plan-parallel to the surface of the sheet material to be subjected to the application so that the trailing end of the application device is supported by the sheet material. Between the application device and the surface to be coated, a hydraulic pressure is generated which floatingly supports the device and which has a uniformizing effect on the application layer.

17 Claims, 6 Drawing Sheets

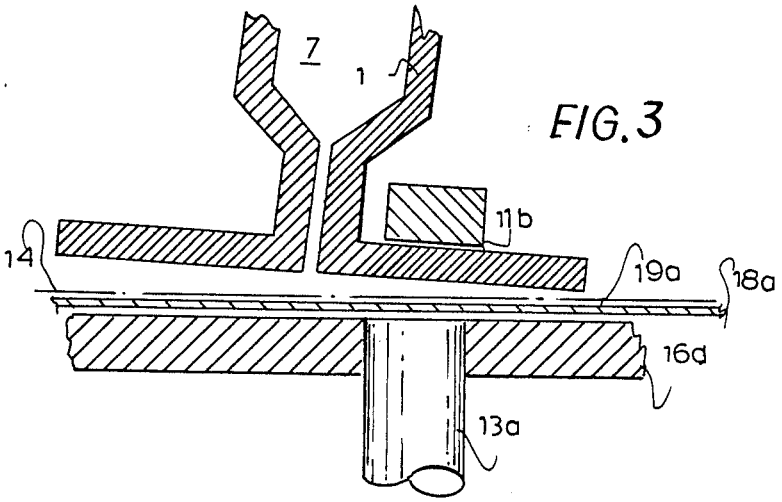
FIG. 3
FIG. 4
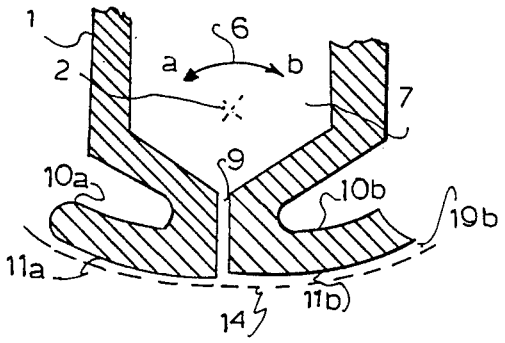
FIG. 5
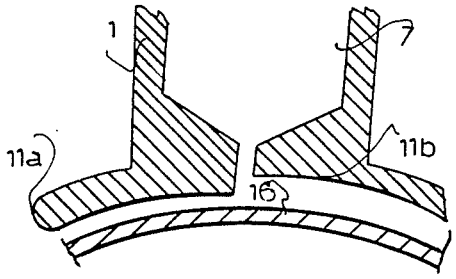

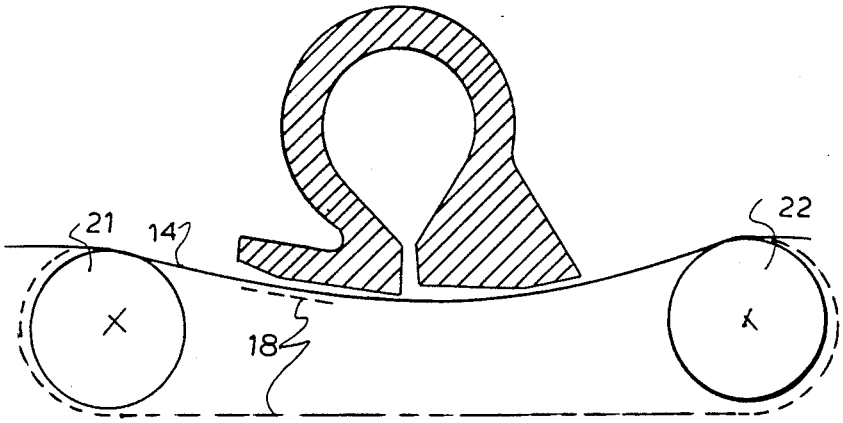
FIG.6
FIG.7
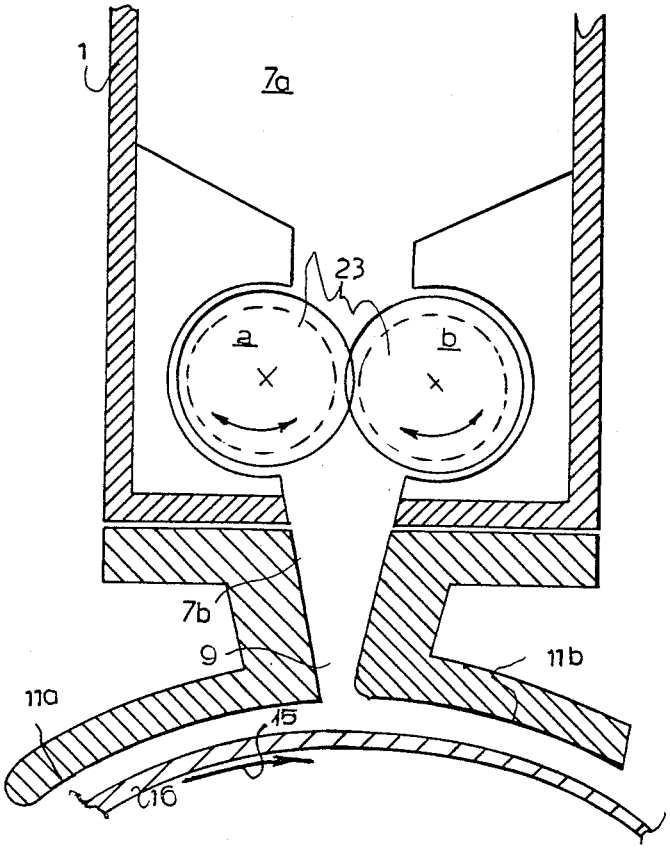

33
30
40
42
41
37
44
32
45
43
a
b
c
50
47
40
31
48
P
39
42
49
46
34
36
35

PROCESS AND DEVICE FOR APPLYING A FLOWABLE SUBSTANCE TO A SURFACE

CROSS REFERENCE TO RELATED APPLICATIONS

This application is a national phase application of PCT/AT 86/00040 filed 6 May 1986 and based, in turn upon Austrian application A 1390/85 of 8 May 1985, under the International Convention.

FIELD OF THE INVENTION

The invention relates to a process and a device for the application of liquid, or foamed substances of any desired viscosity and density for the impregnation and/or coating of flat or curved surfaces, e.g. sheet-like materials.

BACKGROUND OF THE INVENTION

According to the heretofore-known state of the art, applicator wipers, as well as slot wipers and thin-layering, or impregnating air wipers are rigidly mounted (fixed). It also has been known to profile the edges of the wiper strip (also called a wiper blade). The shapes of these profiles vary generally the wiper profiles are narrow, because otherwise the application pressure would be too high. The term of "too high" is to be understood as follows:

The term "too high", with respect to a substance to be applied which lies freely on the substrate in front of the wiper strip, means a pressure under which the material would escape in a direction opposite to the direction of movement and this way would evade the intended application, particularly a coating application- in an undesirable manner, so that large application quantities could not be handled. The wider the application surface covered by the wiper, the higher is the total pressure, which increases proportionally with the surface according to the basic principle of hydraulics, or the counterpressure resulting therefrom at the wipers.

This is the reason why, according to the present state of the art, coating and impregnating installations with wipers have to be strong and dimensioned correspondingly with considerable material consumption and expenses even for a relatively reduced width of the applicator profiles.

The efforts to keep the wiper profiles according to the present state of the art as narrow as possible in their effective areas, almost blade-like, are therefore based on technological reasons and technical (physical) limits and is to be considered a specific feature of the heretofore-known state of the art.

As far as heretofore known, the coating or impregnating wiper spars (also named doctor blades) are as a rule fastened at both their ends, or mounted rigidly, or adjustably with respect to the position of the sheet material to be coated, whereby in the construction special attention is given to the stability against deviations or to possibilities for the correction of unavoidable deviations.

In order to illustrate the precision in manufacturing and setting of such devices, the following example may be mentioned: If a liquid substance with the fluency of water has to be applied in an amount of 50 g/m$^2$, this will correspond to a layer thickness of 5/100, i.e. five hundredths of a millimeter. If this coating has to be applied with a precision of plus or minus 10%, this corresponds in the substance quantity to plus/minus 5 grams and in the layer thickness to plus/minus 5/1000 mm. Since in practice, the width to be coated usually averages 2 to 3 m and more, the requirements for stability, for the operational and adjustment precision of such installations are usually very high. Each particular application process generates an application pressure depending on several parameters or makes it a requirement. Since its magnitude can not be calculated in advance, almost any application process makes it necessary to perform readjustments at the wiper device. It is therefore appropriate to keep the edges, or surfaces of the wiper profiles effectuating the application process and therefore exposed to the application pressure, as narrow as possible (the term doctor blades used in practice makes this very clear).

Some sheet materials are so sensitive that they can not be touched during the coating or impregnating; e.g., fleece, when not reinforced, falls into this category. For applications on this type of material wiper devices are not suitable. In order to reinforce the fleece through impregnation, presently very cumbersome and expensive technologies have to be used.

SUMMARY OF THE INVENTION

The present invention excludes all the afore-mentioned disadvantages, and in addition offers some advantages unknown and inconceivable to the present state of the art, such as the full insurance against deflection danger, at any desired operational width and the automatic adjustment of the slot size to the application conditions, whereby the application pressure upon the surface of the coating device can be adjusted at will and the slot can be modified even during the application process, without endangering the straight alignment of the applicator device or the coating uniformity over the entire width of the web.

An important difference from the technological point of view between the state of the art and the here-introduced new technology is that in the heretofore-known wiper devices, the substance to be applied is supplied in any quantity or width, thereby uncontrollably influencing the application process while the amount to be applied is ultimately determined only by the adjusted slot width, respectively by the pressure ratio at the contact area between the wiper blade and the sheet material. In the case of the invention it is possible to precisely predetermine the quantity to be applied due to two features: the substance supply takes place through a slot immediately preceding the application wiper and bounded on all sides; the width of the slot is adjustable, so that uncontrolled contact between the substance to be applied and the surface to be coated can not occur. Besides the substance to be applied can be supplied to the delivery slot under hydraulic pressure by means of a dosage supply system. The delivery slot and the dosage supply system can be compactly connected with the application device or they can be separate parts.

Also when the substance is supplied from an upwardly open trough, by establishing the width, shape and height of the delivery slot, through the viscosity of the substance and its level in the supply trough, a dosing efect, namely a predetermination of the quantity to be applied, results.

In the heretofore-known coating or impregnating application wipers, the application speed is considered as an undesired influence on the quantity to be applied, namely as an uncontrollably disturbing factor, meaning that with increasing application speed, the pressure ratio effective in the slot area decreases, whereby the quantity to be applied increases. The process according to the invention avoids also this disadvantage.

The possibility to close the delivery slots when production is interrupted and the avoidance of air access to the substance to be applied using a closed supply system are additional characteristic advantages of the invention.

In the known wiper devices the substance supply is effected by gravity, which limits the possibilities of arranging these devices in space. This limitation is eliminated in the process technology according to the invention, which supplies the substance from a closed supply system under pressure.

The technology according to the invention operates with considerable less application pressure with respect to the surface unit, compared to the known application wipers, whereby this application pressure, due to the large width of the effective application surfaces, or the plane-parallel or almost plane-parallel arrangement thereof and the surface to be coated generates a relatively high total application power, which, as a result of the substance layer existing between the two surfaces, causes an effect which can be defined as "floating"; the application surface of the device according to the invention effecting the application and uniformization can float freely on the surface to be coated or, in the case of fixed mounting of the application device, the flat sheet material pressed against the device can float on the application surface.

In the known applicator devices with wipers, the tendency is to avoid a floating effect as much as possible, because the control over the quantities to be applied can be lost. However, in the device according to the invention, this effect is desirable, because the quantity to be applied is determined by the dosage system of the substance supply, since this loose-contact floating application is gentle, and has a uniformizing and protecting effect on the material to be coated.

If the substance to be applied is increased in volume by prior foaming, the advantage of the free floating offers the possibility to work on highly sensitive materials, such as unstiffened fleece and to fully impregnate it (stiffen), without touching the web of material with the application device which was not possible with the known state of the art.

This effect can be achieved by adjusting the applicator surface very precisely in a plane-parallel position or with a slight wedge-like inclination with respect to the sheet material and by heavily foaming the substance to be applied, so that even in the extreme areas of the application surface, after the already completed substance impregnation of the sheet material, there is still a remainder of the foamed substance on the surface of the material, which is decomposed only after the application process is concluded, which generates an additional, as a rule very desirable, stiffening of the sheet-material surface.

According to the present state of the art, as a rule a multitude of different wiper devices are necessary in practice, in order to meet the various application requirements; the invention makes it possible to handle a multitude of various applications, characterized by a high-quality execution, with the same device, whereby, of course, only the adjustment parameters are modified.

In addition to the already mentioned adjustment parameters, the adjustability of the mechanically acting application force, namely the force with which the applicator surface is pressed against the substance layer, and through this, against the sheet material to be coated, is of particular importance, since thereby in the case of impregnating applications, the penetrating depth and in the case of coating applications, the uniformization of the coating to be applied and the intensity of the bond formed between the substance being applied and the surface of the material can be controlled very effectively. This control possibility is of great importance and has a very positive effect particularly in the case of combined applications, wherein a certain fraction of the substance being applied has to impregnate and penetrate to a certain depth, while in addition, another fraction of the substance has to be spread to coat the surface of the material.

The invention enhances or changes the working pressure of the applicator, resulting preferably from its own weight, during an application sequence, by magnetic means, and thus has a positive effect on fine-tuned corrections for the improvement of the respectively required application results.

The exit opening of the apparatus according to the invention does not have to be a continuously throughgoing delivery slot, but can also consist of closely adjacent or mutually overlapping, pipe-, channel-or slot-shaped discharge openings, bores or the like, particularly in the case of thin application substances. As a result of the relatively broad uniformization zone following the substance delivery opening, the danger of an irregularly striped application due to a stripe-like discharge of the substance is relatively small.

The possibility exists, according to the invention, to arrange the application surface slightly inclined and deviating from the plan-parallellity, and, with a trailing end considered in the direction of movement with respect to the sheet material being coated, to permit the creation of a flat, wedge-like clearance, tapering in the direction of application, is effective for the application of voluminous materials, for the gradual penetration of the substance, under gentle surface pressure. When the application surface is inclined so that the trailing end is in contact with, and supported by, the sheet material and lengthwise (seen in the direction of movement) very generously dimensioned, a relatively thick, relatively low-absorbancy sheet materials can be very effectively impregnated.

Some sheet materials have here and there thicker portions or incorporate foreign particles, which at the common wipers with narrow slots and pressed against the material can adhere to the wiper and cause ruptures in the sheet material. The wedge-like inclination of the applicator surface and the opposing face, optionally located in the area in front of the delivery slot and optionally creating a slightly wider slot, minimize these dangers. Also, the frontally open wedge-like clearance, is very favorable for the applications on very thick, respectively voluminous materials.

BRIEF DESCRIPTION OF THE DRAWING

In the drawing:

FIG. 3 is a section of a further embodiment with a flat application surface;

FIG. 4 is a cross section of an embodiment with a convexly shaped application surface;

FIGS. 5 to 9 are sectional views of further embodiments according to the invention

SPECIFIC DESCRIPTION

Figure 1:
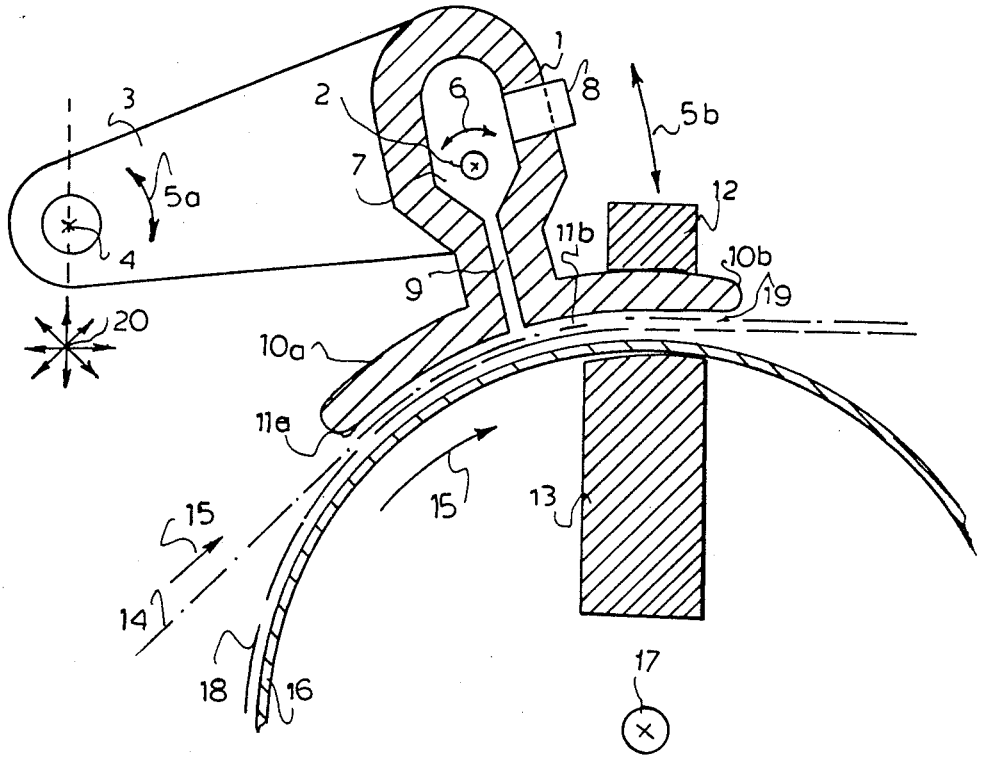
FIG. 1 is a sectional view which shows the application device with a concavely shaped application surface.

FIG. 1 shows the application device 1, which is mounted via a rotatable fastener 2 by means of a connection 3 or a rigidly supported and optionally thereto fixable oscillation point or oscillation axis 4.

The two arrows 5*a* and 5*b* show the oscillation possibility of the device 1, the arrow 6 indicates the oscillation possibility of the device 1 around the rotation center 2. The device 1 in the embodiment of FIG. 1 has inside an enclosed hollow space 7 for the substance to be applied with a connection 8, for the external supply of the substance. From the inner space 7, the substance reaches the application zone through a delivery opening, which can consist of a slot or of two closely adjacent channels. The preferably slot-shaped opening 9 is surrounded and defined by a nozzle structure 10 which has at its bottom the segments 10*a* and 10*b* defining the slot margins by surfaces 11*a* and 11*b*, facing the surface 14 to be coated and extending respectively counter to the direction of displacement 15 of the web 14 and in this direction.

As a result of its mobility around the oscillation point 4, the device 1 is pressed against the substrate by its own weight, an effect which can optionally be enhanced by additional auxiliary means, such as a weight 12. This weight 12 can be made of magnetizable material, so that the pressing effect of the device 1 toward the substrate, and particularly on its surface 11*b*, can be additionally increased by the magnetic force generated by magnet 13.

The web 14 of sheet material to be coated is carried towards the application device 1 by a roller 16, turning around the axis 17, in the direction of arrow 15. It is also possible to use a conveyor belt 18 for the transportation of the sheet material 14. The device 1 and the roller 16 are mounted axially parallel to each other. The roller surface and the sheet material 14 to be coated, are also plane-parallel in axial direction, and considered in the direction of movement, almost plane-parallel with respect to each other, forming a flat, wedge-like clearance, tapering off in the direction of movement.

In rest position, the device 1 can rest against the sheet material 14 with the trailing end considered in the direction of movement of its surface 11*b* with respect to sheet material 14. This pressing against the substrate in the area 19 can also be maintained during operation, when an impregnating application is desired and the force pressing the device against the substrate is sufficiently large.

In the case of coating applications, or applications which are partially coating and partially impregnating, the device 1 begins to float on the substance layer present between the applicator surface 11*b* and the sheet material 14, the substance layer having a wedgelike shape, whereby the substance layer is evenly distributed over the sheet material 14 and a clearance corresponding to the thickness of the substance is formed in the area 19.

The reference number 20 illustrates that the position of device 1 is changeable in desired directions, via the oscillation point, or axis 4, while maintaining the parallelism of this axis 4 to the axis of the roller 17. This adjustment possibility is in addition to the adjustment possibility resulting from the swinging around the axis 2.

While in the application devices working via clearances corresponding to the state of the art the height of the clearance is adjusted in advance as the most important parameter of the application process and has a determining effect on the amount to be applied and on the thickness of the substance layer, in the device according to the invention, the amount to be applied is primarily determined by a substance supply system positively feeding the chamber 7 and the surface 11*b*, and its extreme area 19 is used only for the even distribution of the substance or for pressing it into the substrate and for the smoothing of the surface of the applied substance.

The device 1 according to the invention and its active application surface 11*b*, can be optimally adjusted by appropriately shaping this surface, through the oscillatability of the device around the axis 2, through sufficiently long dimensioning of the surface 11*b* seen in the direction of movement, and through favorably setting the pressing force, so as to meet any application requirements.

Optimally, specifically in applications where an impregnating effect is desired, the penetrating depth of the substance into the sheet material 14 can be determined, while in applications where only a coating effect is desired, unintended penetration of the substance can be prevented and the layer thickness can be determined; in either case, whether the application is impregnating, or coating; or both combined, the amount to be applied can be established precisely and this setting can be reproduced.

The process technology according to the invention creates the possibility to differentiate between the liquid pressure which can be determined by the substance supply system and the application pressure originating from the configuration, the dimensioning of the surface 11*b* and the force pressing the device 1 and the surface 11*b* against the sheet material to be coated or against the substance layer located therebetween, which are caused by the applicator device. This differentiation separating the operational pressure into two different components, each of them being separately controllable, was not possible according to the state of the art.

FIGS. 2 to 5 show further variants of the invention. The substance space 7 in each is shown to be trough-shaped and open upwardly. When the substance supply is done from an open trough, the hydraulic pressure of the supply system acting upon the application area is determined by the filling level, the dimensioning of the delivery area and the viscosity of the substance to be applied.

Figure 2:
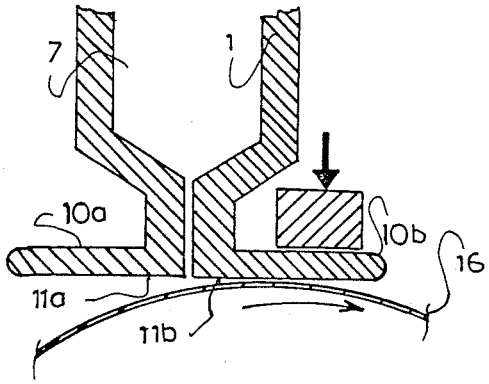
FIG. 2 shows another embodiment in section wherein the applicator surface is flat.

The variant illustrated in FIG. 2 has a flat configuration of the parts 10*a* and 10*b* and the surfaces 11*a* and 11*b*. In FIG. 2, a counter-roller 16, having preferably a large diameter is used, whereby, with the surface-parallel arrangement as a prerequisite, between the surfaces 11*a* and 11*b* of the device 1 and the surface of the roller 16, a similarly shaped wedge-like clearance with similar effects upon the application functions as the one shown and described in FIG. 1, is created. The sheet material 14 has not been represented in FIG. 2, in order to indicate that the process according to the invention and the device according to the invention allows for indirect applications, which means that a substance layer can be first applied to a carrier (such as a roller or conveyor belt) and from there applied to the sheet material.

The embodiment shown in FIG. 3 is different from the afore-described embodiment, because instead of a roller 16, a gliding surface 16*a*, with the possibility to incorporate a magnet system 13, is used. Over the gliding surface glides an optionally elastic conveyor belt 18*a*, whereon the sheet material 14 to be coated rests or whereto it is temporarily fastened. The end zone 19*a* of the surface 11*b* has a sharp edge.

In FIG. 4, the parts 10*a* and 10*b* and their surfaces 11*a* and 11*b* facing the sheet material are shaped convexly towards the outside. The surface 11*b* is staggered in its frontal area bordering on the delivery slot 9, respectively set back with respect to the surface 11*a*. This is necessary when considering that the sheet material 14, which is elastically bendable, has to be kept pressed against the surface 11*a*, also during operation. The characteristic features of the invention are essentially concentrated in the surface 11*b* and continue to be fully preserved also in this variant according to FIG. 4. The end section 19*b* of the surface 11*b* has a sharp angular configuration in this embodiment variant. When the device 1 according to the invention is swung around the axis 2 in direction of the arrow 6, in the case of a swinging motion in the direction 6*a*, the surface 11*a* is subjected to an additional load and the surface 11*b* is relieved by an equal load. When the swinging motion follows the direction 6*b*, an opposite load modification occurs.

FIG. 5 shows a device 1 according to the invention, based on a combination of characteristically shaped elements already contained in FIGS. 1 to 4. The surface 11*b* is retractedly staggered with respect to the surface 11*a*, similar to FIG. 4, and additionally staggered in itself one more time in an inclined manner.

FIG. 6 shows a further combination possibility of a device 1 according to the invention, whose characteristic details have already been described in earlier drawing figures. The sheet material 14 is guided over two rollers 21 and 22, optionally supported on an endless conveyor belt 18, which is only partially shown in the drawing.

FIG. 7 shows a further embodiment variant of the process and the device according to the invention, whereby the hollow space 7 of the device 1 is subdivided into an upper area 7*a* and a lower area 7*b*, which can be put under pressure by the gear pump 23*a* and 23*b*. The closed hollow space 7*b* continues with the delivery slot 9, through which the application substance is squeezed out, and then reaches the area between the roller surface 16 and the surface 11*b*, as a result of the pressure generated by the pump system and of the movement of the roller 16 and the thereon supported sheet material, not shown in this figure.

Figure 8:
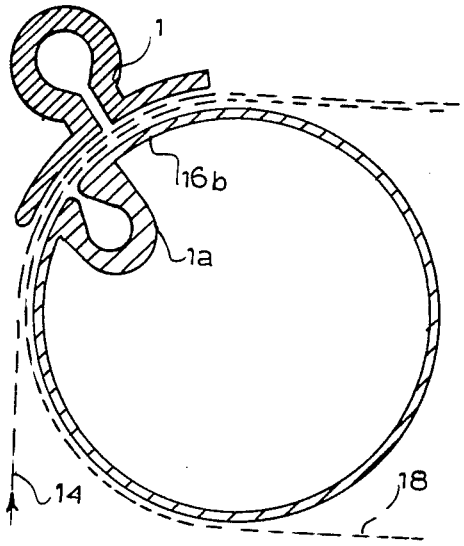
Figure 9:
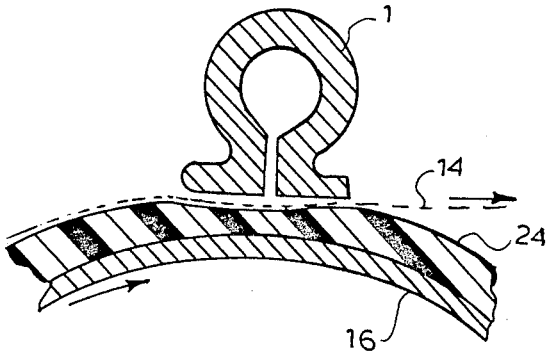
Figure 10:
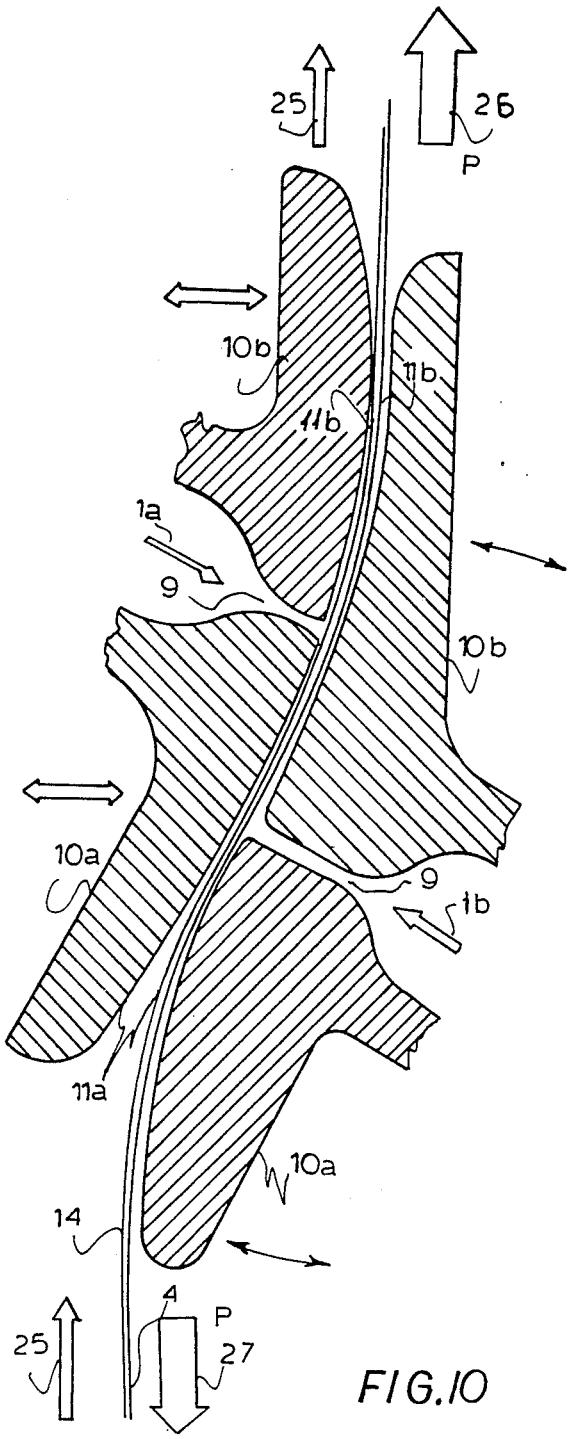
FIG. 10 is a section of a special embodiment with two application devices.

FIGS. 8 to 10 show the process according to the invention in use for two-sided applications, in two embodiments.

FIG. 8 shows an applicator 1 basically as already described and illustrated and an applicator 1*a*, opposite to the first, which in this example is enclosed in a cylindrical hollow gliding body 16*b*, whose shape complements the shape of the applicator 1. The sheet material 14 glides over the rigidly mounted sliding body 16*b*. For a traction-sensitive sheet material 14, an additional substance-permeable conveyor belt 18 can be used.

The two applicators 1 and 1*a* can be supplied from two different supply systems, which together supply the desired amount of coating substance, or both applicators 1 and 1*a* can be supplied from the same supply system, which supplies the total amount to be applied to both sides, which is distributed to the two applicators either automatically, through pressure balance, or through additional auxiliary means.

FIG. 9 shows a device 1 according to the invention, resting against a roller 16, whereby the roller 16 with a relatively large diameter, is provided with a relatively soft layer 24, elastic under pressure. The device 1 is pressed against the turning roller 16 and the soft layer 24 covering the roller is deformed.

FIG. 10 shows a two-sided application device according to the invention, with a sheet material 14 freely guided past it as in FIGS. 4 and 6. The arrow 25 shows the direction of travel of the sheet material, the arrow 26 shows the tensile forces and the arrow 27 shows the forces counteracting the tensile forces.

In the FIG. 10 only the respective delivery slots 9 and the parts 10, respectively 10*a* and 10*b* surrounding the slots and determining the application process, with their surfaces 11*a* and 11*b* turned towards the sheet material, are illustrated.

The characteristic by which this embodiment variant completes the invention consists in the fact that each of the two applicators according to the invention, located on both sides of the sheet material, generates the doubly-acting application pressure, as well as it absorbs the application counterpressure produced by the opposite application device.

Figure 11:
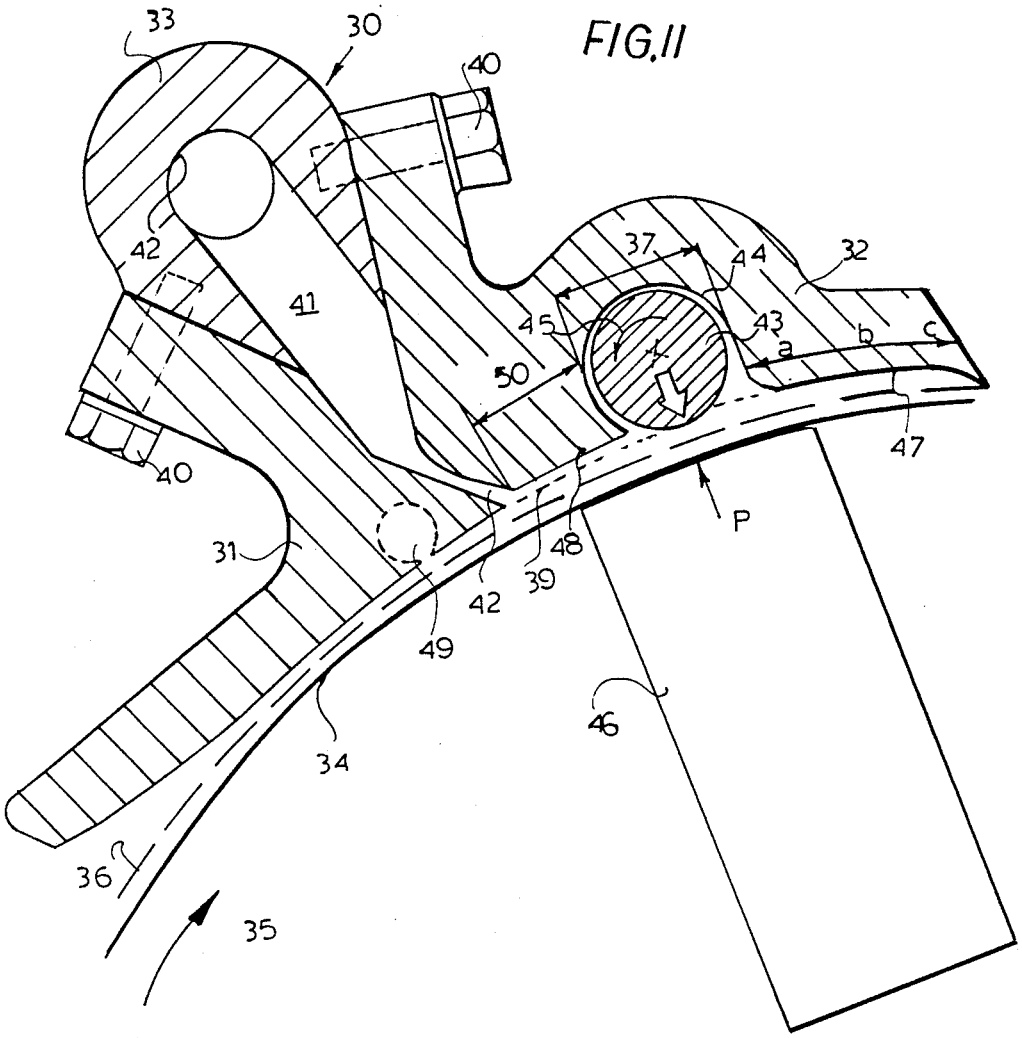
FIG. 11 shows a further embodiment of the invention in section.

In FIG. 11, the sheet material is guided between the two application devices, respectively their surface parts 11*a* and 11*b*, following a curved path, with the shape of a flat S.

The embodiment variant shown in FIG. 10 is additionally characterized by the fact that either one of the two surfaces 11*a* or 11*b* in the same application device, can be by choice shaped concavely, and the other surface 11*a* or 11*b* can be convexly shaped, whereby the two surfaces can be coplanar with the delivery slot 9 situated between them, or staggered with respect to each other.

In the case of two-sided application, as shown, the two delivery slots 9 can be offset to one another or precisely opposite to each other.

In FIG. 10, the sheet material is guided in vertical direction, but this can be arranged in space in any other way, provided that hollow spaces 7 are enclosed spaces, in accordance with the spatial arrangements.

Whether in the case of two-sided application the two devices are freely moving with respect to each other, or one is fixed and the other one mobile, constitutes a further characteristic feature of the invention.

From this afore-described possibility to mount rigidly, e.g. to fasten undisplaceably one of the devices according to the invention working together as a twosome, combined for the purpose of two-sided application results a further new technological possibility according to the invention, which is advantageous particularly in cases where foamed substances are to be applied on sheet material which is to be impregnated as deeply as possible, without its surfaces being touched by mechanical parts of an applicator. But first it should be pointed out that the possibility to fixedly mount the device according to the invention and also to support the sheet material in a fixed manner on a gliding or conveying surface during the application process, so that an unchangeable setting of the clearance, respectively, more precisely, a setting of the clearing surface results, but which can not be confused, respectively equated with the setting of the clearance in the wipers of the state of the art, since a clearance setting according to the known art is performed only for the purpose of determining the quantities of substance to be applied or of the coating thickness, while according to the invention, the quantity of substance to be applied is basically determined by the substance supply system, and the surface 11*b* serves only for the uniformization of the layer and the layer surface, as well as for pressing the layer against the sheet material, and optionally, deep into the sheet material.

A further still possible new process and device embodiment variant, in connection with the application of foamed substances, consists in regulating—in coating as well as impregnating applications—the amount of substance to be applied and also optionally its penetrating depth only through changes in the composition of the substance, e.g. of its content of liquid, which is mixed into the foam material to be applied. In impregnation applications, the air pressure of the foam generating system, or the resulting pressure of the foam, can also be involved in the control of the penetration depth of the substance. Therefore, the invention permits various amounts of substance to be applied and various penetration depths, without direct contact during the application, with only one application device and with a constant setting of this device, solely through the changes in the density of the foam, and optionally also in the foam pressure.

A further process variant, as shown in FIG. 10, where two devices are arranged for a two-sided application, is to feed substance from one side and air from the other, so that this way an air cushion, benefitting the gliding of the sheet material, is created. This variant is advantageously suited for the coating application on air-tight material; in the case of impregnating applications on air-permeable material, it is also possible to have air-suction at the back side, instead of blowing air towards the back side, in order to facilitate this way the penetration of the substance. Of course, it is also possible to arrange one air-suction area and a corresponding air-blowing area or a substance application area, back-to-back- succeeding one another.

A further characteristic of the invention consists in the fact that the butting face 11*a* is not only arched, but is also provided with spreading profiles on its material-supply side.

The application device can oscillate between positions ranging from exactly plan-parallel to a flat inclination, for instance of about 5°.

The convexly shaped application surface works similarly to a so-called air wiper, but in comparison thereto, it has the additional advantage that the application performance does not depend so much on the tensioning of the material, since the device according to the invention, is weighted down or relieved due to its own or some additional weight and comes to lie freely on the substrate of sheet material, and furthermore can be used as a tension regulator. As opposed to the air wiper known to the state of the art, there is no danger that differences in tension will lead to differences in the application, primarily because the substance to be applied can be precisely portioned in accordance with the invention.

FIG. 11 shows an application device 30 which here cooperates with a magnetic roller 34 as a mating surface. But it has to be pointed out right away that instead of the roller 34, a flat surface, for instance and endless conveyor belt, can be used, whereby the sheet material to be coated is supported, either directly or indirectly via the conveyor belt, on a flat or, if needed, arched table surface, with a magnet mounted therein or thereunder.

The application device 30, which extends over the respective application width, consists of a preferably plate-shaped part 31, considered in the direction of travel, a rear part 32 considered in the direction of travel, and part 33 which connects these two parts 31 and 32. As already mentioned, this application device 30 cooperates with a counter-roller 34, whose direction of rotation is indicated by the arrow 35. As can be seen from the drawing, the three parts of the device 31, 32, 33 are sealingly connected by the bolts 40, whereby a hollow space 41 is created, which is supplied with pressurized substance to be applied through one or several openings 50. A funnel-shaped portion makes the transition between the hollow space 41 and the nozzle slot 42, wherefrom the medium to be applied can exit in uniform quantities, overcoming the counterpressure originating from the applicator. When exiting the nozzle 42, the substance to be applied makes contact with the sheet material 36.

Both frontal ends of the application device 30 are each sealed with an end plate, respectively almost sealed against the sheet material 36 to be coated, or the roller, conveyor belt or the table.

The shape of the end plates corresponds to the device parts 31, 32, 33, however the two end plates exceed slightly the application surface 48 in the application areas 50 and 37. The application surface 48 extending over a portion 50 of the applicator 30 insures that the hydraulic pressure of the delivered substance is maintained in this area, respectively is perhaps even increased by the impact forces originating in addition from the kinetic energy and which can be exhausted, respectively partially exhausted from this flat, enclosed, hollow space only towards the sheet material 36, respectively if necessary by penetration into the sheet material 36. If and when this takes place depends on the totality of the parameters causing and influencing the application process, respectively the following factors: configuration, supplied quantity and pressure of the substance, shape, dimension and arrangement of the intermediate clearance, length of the application surface 38, the distance between this application surface 38 and the sheet material 36, weight of the applicator device 30, or the range of the counterpressure to which the applicator device 30 is subjected over this application surface 48, the capacity of the sheet material to absorb the substance, thickness of the sheet material, the sealing effect offered by the end plates, the force pressing the roller 43 against the sheet material 48 which it touches behind the application surface 48, the spacing between the roller 43 and the bearing surface 44 which partially surrounds it, and finally also the speed with which the sheet material 36 is moved and the rotational speed of the roller 43.

As can be seen from FIG. 11, the application surface 48 ends at a recess 44, wherein a roller 43 is arranged in the manner of a sleeve bearing, which turns in accordance with the arrow 45. This roller 43 consists of a magnetizable material and preferably its length corresponds to the application width, but it can also be longer. A magnet, respectively a magnet bar 46 is located opposite to the roller, which presses the roller against the sheet material 36 with a force P, adjustable to the respective requirements of the application process.

The application surface 48 and also the roller 43 are not only effecting the pressing of the substance against or into the substrate, but also take care to maintain a constantly even distribution of the substance over the application width, such as predetermined by the nozzle exit slot 42, and even to improve this evenness of distribution, namely in addition to the reinforcement of the bond between sheet material and the substance to be applied, whereby also the surface is evened out, respectively smoothened.

In the embodiment illustrated in FIG. 11, the part 32 of the application device 30, seen in the direction of travel, has a further area 38 in addition to the areas 50 and 37. This area 38 can be subdivided in subsections a, b, c. In accordance with the respective requirements of the application process, the lower surface 47 of the area 38 can be arranged plan-parallel to the sheet material 36, respectively its support, either widthwise and lengthwise, or only widthwise, or it can be shaped, respectively positioned in such a manner that slightly wedge-like flat surface results, whose point corresponds to the subdivision c and its largest opening to the subdivision a. When the application has to fully penetrate the sheet material 36, the applicator 30 presses against the sheet material 36 with adjustable weight in the subdivision c, in the case of a coating or a combined coating- and impregnating application, after passing the application areas 50 and 37, a substance layer remains on the surface of the sheet material, which is evened out and finished by the surface 47, particularly by its last subdivision c, whereby the application device 30, in the area 38, respectively in the subdivision c, can no longer touch the structure of the sheet material 36 introduced in the application device 30 in the area of the part 31, but almost floats on the substance layer present on the surface of the sheet material 36 to be coated.

The part 32, and particularly the segment 38 can also be made of magnetizable material and can insure, either additionally, or instead of the roller 43, the pressing force of the applicator 30 over the part 32 by means of magnetic force. It is possible to press against the substrate the roller 43 as well as the application device 30, independently of each other. It is possible to eliminate the roller 43, and then to press the freely moving applicator 30, by magnetic force, over its part 32 against the substrate. The hollow space 44 created through the elimination of the roller 43 can be otherwise utilized for an auxiliary function such as fiber-and foreign-substance removal by means of vacuum or a heat shock produced by an infrared-heater rod, to mention only two examples. Also, the hollow space can be closed towards the sheet material 36 with a thin wall in order to receive a heating- or also a cooling medium.

In addition to the hollow space in the part 32 or the open or closed hollow spaces in this part of the applicator 30, it is also possible to arrange one or several such hollow spaces for auxiliary functions of the application process in the part 31 of the applicator 30. Such a possibility is suggested by the opening 49. This hollow space 49 open towards the sheet material 36 can for instance be connected with a vacuum system, so that the sheet material is cleaned and/or deaerated, prior to its contact with the applied substance. Both steps can have an enhancing effect on the quality of the application process.

In order to intensify the deaeration, the vacuum zone can be preceded by a similar magnetic roller system as is the case with the part 32, which through dearation under pressure and sealing of the suction area can make a further contribution to the quality improvement. The pressure roller 43 mounted in the part 32 can be provided with a structured surface, such as axially or diagonally oriented grooves or cup-like depressions, serving for improving and uniformizing of certain applications, particularly in impregnating applications.

The invention is suited in various embodiment variants for each application zone. When only small amounts of substance have to be applied and also when the applied substance is not supposed to penetrate deeply into the sheet material 36, preferably foamed application substances are used. For certain types of applications, it is suitable to arrange the application surface 48, considered in the direction of travel not plane-parallel as shown in FIG. 11, but also somewhat inclined, such as is the case of surface 47 in FIG. 11. This inclined position of the surface 48 makes possible that a wedge-like substance pressure-zone is created in front of a magnetic pressure roller, whereby the dimensions and the configuration of this pressure area are not dependent from the diameter of the magnetic pressure roller, this pressure zone being clearly defined, limited and also sealed againt the roller, not only when considered in the direction of travel, but also in the contrary direction. This combination of technological measures, extremely favorable with regard to the quality of the application and the possibility of finely-tuned applications of small amounts of substance, makes possible in the first place to treat the application process from the point of view of substance pressure on the sheet material, as involving three distinct pressure zones, whose two factors are controllable:

(a) the hydraulic pressure of the supply system, which is predominant in the area immediately after the nozzle exit slot 42 (first contact between the sheet material 36 and the substance);

(b) hydrodynamic impact pressure in the clearance area between the application surface 48 and the sheet material 36; and (c) impact pressure in the wedge-like clearance, immediately before the contact with the roller 43.

It is also self-understood that the application surface 48 can be wider as well as narrower than shown in FIG. 11.

The floating arrangement, or the contact-less application represent only one possible variant which is, however, exceptionally favorable.

The invention is not limited to the illustrated examples; for instance any desired arrangement in space of the applicator parts is possible and the number of application devices can also be doubled, which is particularly advantageous in the case of two-sided applications. Both applicator devices can work on the surfaces to be coated, without making contact therewith.

What is claimed is:

1. A process for applying a flowable substance to a surface, comprising the steps of:

(a) displacing a surface to which a flowable substance is to be applied in a predetermined direction;

(b) juxtaposing said surface with an applicator having a slot opening toward said surface, and a broad face confronting said surface and extending generally along said surface from an edge of said slot in said direction to a trailing end portion of said applicator;

(c) floatingly supporting said applicator relative to said surface so that hydrostatic pressure on said broad face tends to urge said applicator away from said surface, while biasing said applicator toward said surface, said surface and said broad face being so shaped that said trailing end portion can move toward said surface; and (d) forcibly feeding said flowable substance through said slot onto said surface so that the amount of said substance applied to said surface is controlled only by the rate at which the substance is forced through said slot and the hydrostatic pressure of said substance between said face and said surface is sufficient to hold said applicator out of contact with said surface except for said trailing end portion which is supported by said surface.

2. The process defined in claim 1 wherein said applicator is floatingly supported relative to said surface by swingably supporting said applicator for movement to a position in which said face includes an angle of up to 5° with said surface.

3. The process defined in claim 2 wherein said applicator is biased toward said surface by the weight of the applicator.

4. The process defined in claim 2 wherein said applicator is magnetically biased toward said surface.

5. The process defined in claim 2 wherein the width of said slot is adjustable.

6. The process defined in claim 2 wherein said surface is formed by a web of material continuously moved past said applicator and passing over a countersurface juxtaposed with said applicator, magnetic material in said applicator being biased toward said countersurface and said surface by magnetic attraction of said countersurface for said magnetic material in said applicator.

7. The process defined in claim 6 wherein said magnetic material is a roller in said applicator which is drawn toward said said countersurface by the magnetic attraction thereof, thereby pressing said substance on said web with said roller.

8. The process defined in claim 6, further comprising the steps of cleaning and deaerating said web before said web reaches said slot.

9. An apparatus for applying a flowable substance to a surface, comprising:

means for displacing a surface to which a flowable substance is to be applied in a predetermined direction;

an applicator juxtaposed with said surface and formed with a slot opening toward said surface, and a broad face confronting said surface and extending generally along said surface from an edge of said slot in said direction to a trailing end portion of said applicator;

means for floatingly supporting said applicator relative to said surface so that hydrostatic pressure on said broad face tends to urge said applicator away from said surface, while biasing said applicator toward said surface; and means for forcibly feeding said flowable substance through said slot onto said surface so that the amount of said substance applied to said surface is controlled only by the rate at which the substance is forced through said slot and the hydrostatic pressure of said substance between said face and said surface is sufficient to hold said applicator out of contact with said surface except for said trailing end portion which is supported by said surface, said means for floatingly supporting said applicator relative to said surface being so constructed and arranged that said applicator is biased by its own weight against said surface.

10. The apparatus defined in claim 9 further comprising a weight provided on said applicator to bias said applicator against said surface.

11. The apparatus defined in claim 10 wherein said weight is composed of a magnetically attractable material, further comprising means for magnetically attracting said material to bias said applicator toward said surface.

12. The apparatus defined in claim 9 wherein said surface and said face have substantially corresponding curvatures.

13. The apparatus defined in claim 9 wherein said face is flat.

14. The apparatus defined in claim 9 wherein said applicator has a further broad face extending from an opposite edge of said slot counter to said direction and juxtaposed with said surface.

15. The apparatus defined in claim 14 wherein said broad face extending counter to said direction is staggered with respect to said broad face extending in said direction so as to lie closer to said surface than said broad face extending in said direction.

16. The apparatus defined in claim 9 wherein said surface is formed by a web of sheet material which is maintained under tension by the bias of said applicator thereagainst.

17. The apparatus defined in claim 9 wherein said face is provided with formations for spreading said substance.

* * * * *